US009945378B2

(12) United States Patent
Kouno et al.

(10) Patent No.: US 9,945,378 B2
(45) Date of Patent: Apr. 17, 2018

(54) SCROLL COMPRESSOR

(71) Applicant: Johnson Controls-Hitachi Air Conditioning Technology (Hong Kong) Limited, Hong Kong (CN)

(72) Inventors: Takeshi Kouno, Tokyo (JP); Tsutomu Nozaki, Tokyo (JP); Yuuichi Yanagase, Tokyo (JP)

(73) Assignee: Johnson Controls-Hitachi Air Conditioning Technology (Hong Kong) Limited, Hong Kong (CN)

( * ) Notice: Subject to any disclaimer, the term of this patent is extended or adjusted under 35 U.S.C. 154(b) by 138 days.

(21) Appl. No.: 14/917,096

(22) PCT Filed: Sep. 12, 2013

(86) PCT No.: PCT/JP2013/074751

§ 371 (c)(1),
(2) Date: Mar. 7, 2016

(87) PCT Pub. No.: WO2015/037106

PCT Pub. Date: Mar. 19, 2015

(65) Prior Publication Data

US 2016/0201678 A1 Jul. 14, 2016

(51) Int. Cl.
*F04C 18/02* (2006.01)
*F04C 23/00* (2006.01)
(Continued)

(52) U.S. Cl.
CPC ..... *F04C 18/0215* (2013.01); *F04C 18/0261* (2013.01); *F04C 18/0292* (2013.01);
(Continued)

(58) Field of Classification Search
CPC ..... F04C 18/0215; F04C 18/0261; F04C 18/0292; F04C 23/008; F04C 28/26; F04C 29/124
(Continued)

(56) References Cited

U.S. PATENT DOCUMENTS 5,829,959 A * 11/1998 Tsubono ..... F01C 17/066 418/55.5
2011/0083434 A1* 4/2011 Peoples ..... F01B 7/20 60/618

FOREIGN PATENT DOCUMENTS

JP 63-52988 U 4/1988
JP 5022010 B2 9/2012
(Continued)

OTHER PUBLICATIONS

Machine Translation JP 2013-019322 Done Sep. 18, 2017.*
(Continued)

*Primary Examiner* — Patrick Maines
*Assistant Examiner* — Dapinder Singh
(74) *Attorney, Agent, or Firm* — Mattingly & Malur, PC

(57) ABSTRACT

Provided is a scroll compressor capable of ensuring reliability of a release valve device. The scroll compressor is provided with: an orbiting scroll having an orbiting scroll wrap; a fixed roll having a fixed scroll wrap intermeshing with the orbiting scroll wrap; a release hole formed in the fixed scroll; a housing hole communicating with the release hole and having larger diameter than that of the release hole; a valve seat member which is housed in the housing hole and has a valve seat surface; a valve plate contacting with or separating from the valve seat surface by a pressure difference; a spring for pressing the valve plate against the valve
(Continued)

seat surface; a stopper which is equipped with the spring and secures the valve seat member; and a retainer for securing the stopper.

11 Claims, 8 Drawing Sheets

(51) Int. Cl.
*F04C 28/26* (2006.01)
*F04C 29/12* (2006.01)

(52) U.S. Cl.
CPC ..... *F04C 23/008* (2013.01); *F04C 28/26* (2013.01); *F04C 29/124* (2013.01)

(58) Field of Classification Search
USPC ..... 418/55.1–55.6
See application file for complete search history.

(56) References Cited

FOREIGN PATENT DOCUMENTS

| | | | |
|---|---|---|---|
| JP | 2013-019322 | A | 1/2013 |
| JP | 2013-036366 | A | 2/2013 |
| JP | 2013-057324 | A | 3/2013 |

OTHER PUBLICATIONS

Machine Translation JP 2008-138644 Done Sep. 18, 2017.*
International Search Report of PCT/JP2013/074751 dated Dec. 17, 2013 and Taiwanese Office Action dated Jan. 27, 2016.

* cited by examiner

SCROLL COMPRESSOR

TECHNICAL FIELD

The present invention relates to a scroll compressor.

BACKGROUND ART

In the past few years, in the refrigeration and air-conditioning industry, there is a growing movement to change a conventional refrigerant to a refrigerant having a low GWP (Global Warming Potential). Currently, as an alternative refrigerant (a next refrigerant) to R410A widely used in an air conditioner, R32, R290, R1234ze and the like are raised as candidate refrigerants.

A candidate refrigerant R32 has a problem that its molecular weight is small and leakage loss increases as compared with R410A. Further, candidate refrigerants R290 and R1234ze have a problem that their volumetric capacity is low as compared with R410A. As a solution to these problems, it is effective to reduce a displacement volume of a compressor and to operate the compressor in high-speed rotation.

However, when operating a scroll compressor in high-speed rotation, there is a possibility that by centrifugal force generated by an orbiting scroll or a motor (rotor), a crankshaft is bent, and reliability of a bearing for supporting the crankshaft is reduced or vibration noise is increased.

In order to avoid this phenomenon, it is necessary to use a lightweight material such as an aluminum-based material for the orbiting scroll. However, when using the aluminum-based material only for the orbiting scroll and using a conventional iron-based material for a fixed scroll, a gap inside the compressor is expanded due to a difference in linear expansion coefficient between the iron-based material and the aluminum-based material, to reduce efficiency. Therefore, it is desirable that a material of the orbiting scroll and a material of the fixed scroll are the same material.

Further, the fixed scroll compresses a refrigerant gas and is provided with a discharge port for discharging the refrigerant gas, and a release valve device for discharging the refrigerant gas at an early stage under the condition that liquid compression or pressure ratio is low. For example, Patent Document 1 describes this release valve device.

CITATION LIST

Patent Literature

{Patent Document 1}
Japanese Patent Application Publication No. 2013-019322

SUMMARY OF INVENTION

Technical Problem

The release valve device of Patent Document 1 includes a valve pressing body made of an elastic member and a guide member, a release valve which is pressed by the valve pressing body, and a valve seat in contact with the release valve. The release valve device of Patent Document 1 has a simple check valve structure, and the release valve is opened when pressure in a compression chamber is greater than a force of the valve pressing body, and the release valve is closed when the pressure in the compression chamber is reduced. In this manner, when the release valve device of Patent Document 1 repeats opening and closing, the release valve and the valve seat repeat collisions with each other, so to speak.

In the release valve device of Patent Document 1, the valve seat is formed integrally with the fixed scroll. Thus, when a material having a low Vickers hardness such as the aluminum-based material is used for the fixed scroll, it is considered that the valve seat is damaged due to the collision between the release valve and the valve seat.

Therefore, an object of the present invention is to provide a scroll compressor capable of ensuring reliability of a release valve device.

Solution to Problem

In order to solve the above problems, a scroll compressor according to the present invention is characterized by including: an orbiting scroll having an orbiting scroll wrap; a fixed scroll having a fixed scroll wrap intermeshing with the orbiting scroll wrap; a release hole formed in the fixed scroll; a housing hole communicating with the release hole and having a larger diameter than that of the release hole; a valve seat member which is housed in the housing hole and has a valve seat surface; a valve plate contacting with or separating from the valve seat surface by a pressure difference; a spring for pressing the valve plate against the valve seat surface; a stopper which is equipped with the spring and secures the valve seat member; and a retainer for securing the stopper.

Further, a scroll compressor according to the present invention is characterized by including: an orbiting scroll having an orbiting scroll wrap; a fixed scroll having a fixed scroll wrap intermeshing with the orbiting scroll wrap; a release hole formed in the fixed scroll; a housing hole communicating with the release hole and having a larger diameter than that of the release hole; a valve seat member which is housed in the housing hole and has a valve seat surface; a valve plate contacting with or separating from the valve seat surface by a pressure difference; a first spring for pressing the valve plate against the valve seat surface; a stopper which is equipped with the spring and secures the valve seat member; a second spring for pressing the stopper; and a retainer for pressing the second spring.

Furthermore, a scroll compressor according to the present invention is characterized by including: an orbiting scroll having an orbiting scroll wrap; a fixed scroll having a fixed scroll wrap intermeshing with the orbiting scroll wrap; a release hole formed in the fixed scroll; a housing hole communicating with the release hole and having a larger diameter than that of the release hole; a valve seat member which is housed in the housing hole and has a valve seat surface; a valve plate contacting with or separating from the valve seat surface by a pressure difference; a first spring for pressing the valve plate against the valve seat surface; a stopper equipped with the spring; a second spring disposed between the stopper and the valve seat member; and a retainer for securing the stopper.

Advantageous Effects of Invention

According to the present invention, it is possible to provide a scroll compressor capable of ensuring reliability of a release valve device.

DESCRIPTION OF EMBODIMENTS

Figure 1:
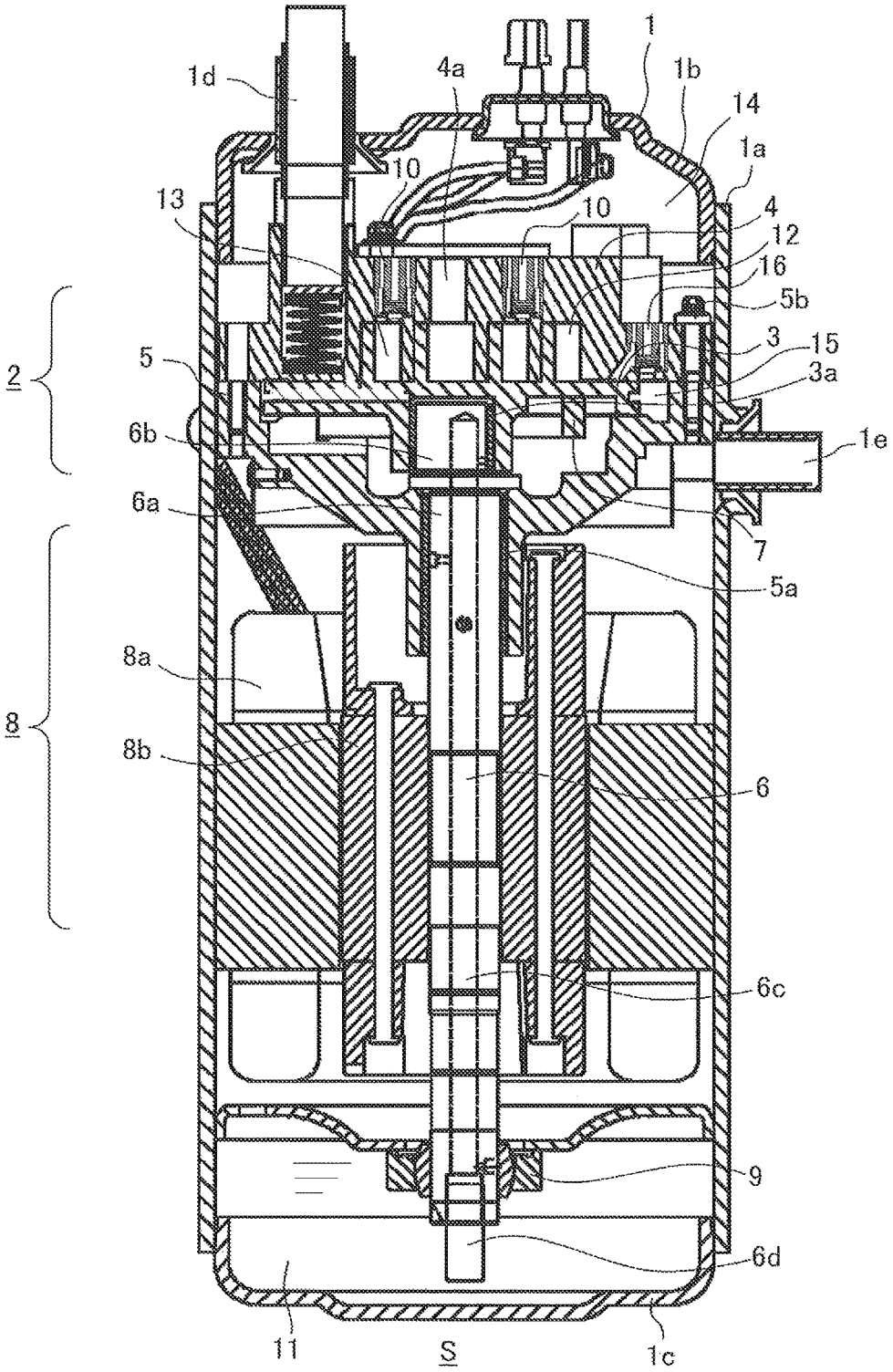
FIG. 1 is a longitudinal sectional view of a scroll compressor according to a first embodiment.

Hereinafter, embodiments of the present invention (hereinafter referred to as "embodiments") will be described in detail with reference to the accompanying drawings. Note that, in each figure, the same components are denoted by the same reference numerals, and a duplicated description thereof will be omitted.

First Embodiment

Scroll Compressor

First, a scroll compressor S according to a first embodiment will be described with reference to FIG. 1. FIG. 1 is a longitudinal sectional view of the scroll compressor S according to the first embodiment.

As shown in FIG. 1, the scroll compressor S includes a sealed container 1, an orbiting scroll 3, a compression mechanism 2 composed of a fixed scroll 4 and a frame 5, a crankshaft 6, an Oldham ring 7, an electric motor 8, a lower bearing 9 and a release valve device 10.

The sealed container 1 is configured such that a lid chamber 1*b* is welded to an upper side of a cylindrical case 1*a*, and a bottom chamber 1*c* is welded to a lower side of the cylindrical case 1*a*. Further, the lid chamber 1*b* is provided with a suction pipe 1*d*, and the case 1*a* is provided with a discharge pipe 1*e*. The compressor mechanism 2 is disposed at an upper portion in the sealed container 1 composed of the case 1*a*, the lid chamber 1*b* and the bottom chamber 1*c*, and the electric motor 8 is disposed at a lower portion in the sealed container 1. Then, machine oil 11 (lubricating oil) is stored in a bottom portion of the sealed container 1.

The compression mechanism 2 is configured to include the orbiting scroll 3, the fixed scroll 4, and the frame 5 which is fastened to the fixed scroll 4 with a fastener 5*b* such as a bolt and supports the orbiting scroll 3.

The orbiting scroll 3 is provided with a spiral orbiting scroll wrap erected from an upper surface side of a base plate thereof, and is provided with an orbiting bearing 3*a*, into which an eccentric portion 6*b* of the crankshaft 6 is fitted, on a lower surface side of the base plate. The fixed scroll 4 is provided with a fixed scroll wrap, which is erected from a lower surface side of a base plate thereof and intermeshes with the orbiting scroll wrap. The orbiting scroll 3 is orbitably disposed opposite to the fixed scroll 4, and a suction chamber 12 and a compression chamber 13 are formed by the orbiting scroll 3 and the fixed scroll 4.

The frame 5 is secured to an inner wall surface of the sealed container 1 by welding at an outer peripheral side thereof, and includes a main bearing 5*a* for rotatably supporting a main shaft 6*a* of the crankshaft 6. Further, a back pressure chamber (intermediate pressure chamber) 15 is formed between the orbiting scroll 3 and the frame 5.

The Oldham ring 7 is disposed between a lower surface of the orbiting scroll 3 and the frame 5, and is fitted into a groove formed on the lower surface side of the orbiting scroll 3 and a groove formed in the frame 5. The Oldham ring 7 serves to revolve the orbiting scroll 3 in response to eccentric rotation of the eccentric portion 6*b* of the crankshaft 6, without rotating the orbiting scroll 3.

The electric motor 8 includes a stator 8*a* and a rotor 8*b*. The stator 8*a* is press-fitted into the sealed container 1, and is secured by welding or the like. The rotor 8*b* is rotatably disposed in the stator 8*a*. Further, the crankshaft 6 is secured to the rotor 8*b*.

The crankshaft 6 is configured to include the main shaft 6*a* and the eccentric portion 6*b*. The main shaft 6*a* of the crankshaft 6 is supported by the main bearing 5*a* provided in the frame 5 at an upper side thereof, and is supported by the lower bearing 9 at a lower side thereof. The eccentric portion 6*b* of the crankshaft 6 is formed with the main shaft 6*a* eccentrically and integrally, and is fitted into the orbiting bearing 3*a* provided on a back surface of the orbiting scroll 3. When rotating the main shaft 6*a* by driving the electric motor 8, the eccentric portion 6*b* rotates eccentrically with respect to the main shaft 6*a* so as to revolve the orbiting scroll 3. Further, the crankshaft 6 is provided with an oil supply passage 6*c* for guiding machine oil 11 to the main bearing 5*a*, the lower bearing 9 and the orbiting bearing 3*a*, and is attached with an oil supply pipe 6*d* for sucking and guiding the machine oil 11 to the oil supply passage 6*c*, at a lower shaft end thereof.

When revolving the orbiting scroll 3 by driving the electric motor 8, gas refrigerant passes through the suction chamber 12 from the suction pipe 1*d*, and is guided into the compression chamber 13 formed by the orbiting scroll 3 and the fixed scroll 4. Then, the gas refrigerant in the compression chamber 13 is reduced in volume to be compressed as it moves toward the center between the orbiting scroll 3 and the fixed scroll 4. The compressed gas refrigerant is discharged from a discharge port 4*a* of the fixed scroll 4 to a discharge pressure chamber 14 which is a space in the sealed container 1, and flows out to the outside through the discharge pipe 1*e*.

The fixed scroll 4 is provided with the release valve device 10 for discharging the gas refrigerant to the discharge pressure chamber 14 before the compression chamber 13 communicates with the discharge port 4*a*, such as when a large amount of liquid refrigerant is sucked during start-up, or when a pressure ratio of discharge pressure to suction pressure, that is, "discharge pressure/suction pressure" is low.

The pressure ratio when the release valve device 10 operates is quantitatively described as follows. Whether or not the release valve device 10 operates, is determined by a relationship between the pressure ratio and a design volume ratio of the scroll wrap. Here, the design volume ratio is a ratio of maximum volume to minimum volume (volume when the compression chamber 13 communicates with the discharge port 4*a*) of the compression chamber 13, that is, "maximum volume/minimum volume". That is, whether or not the release valve device 10 operates, is determined by a shape of the scroll wrap and operation conditions, and the following relationship is satisfied between the pressure ratio and the design volume ratio.

(discharge pressure)/(suction pressure)<{(maximum volume)/(minimum volume)}^(adiabatic index) (1)

When equation (1) is satisfied, the release valve device 10 operates.

(discharge pressure)/(suction pressure)>{(maximum volume)/(minimum volume)}^(adiabatic index) (2)

When equation (2) is satisfied, the release valve device 10 does not operate.

<Conventional Release Valve Device>

Figure 9:
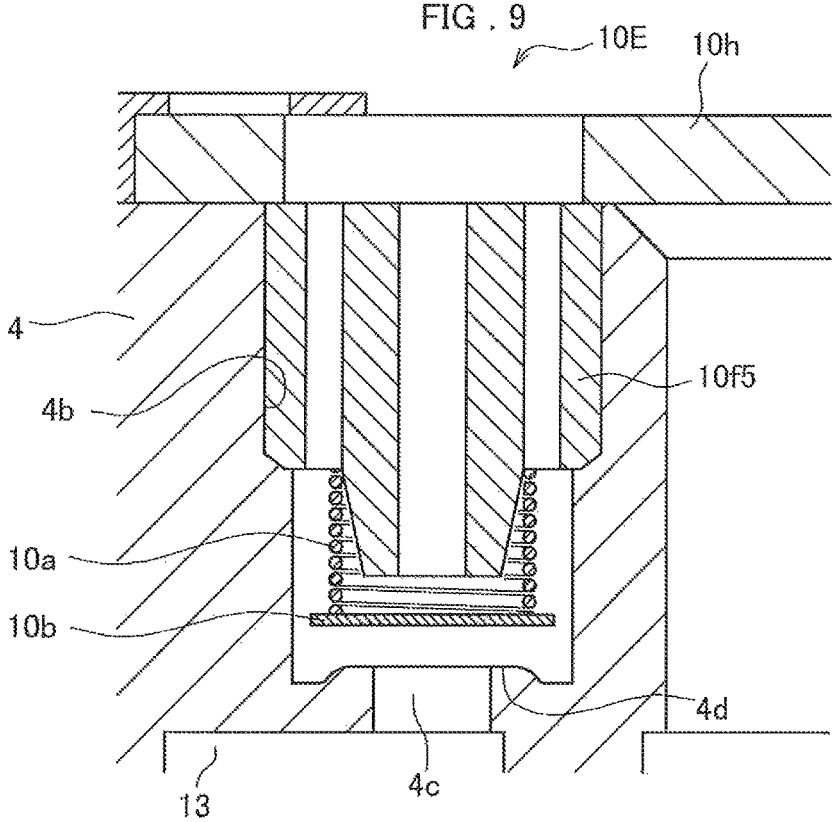
FIG. 9 is a cross-sectional view showing a valve open state of a release valve device according to a conventional example.
Figure 10:
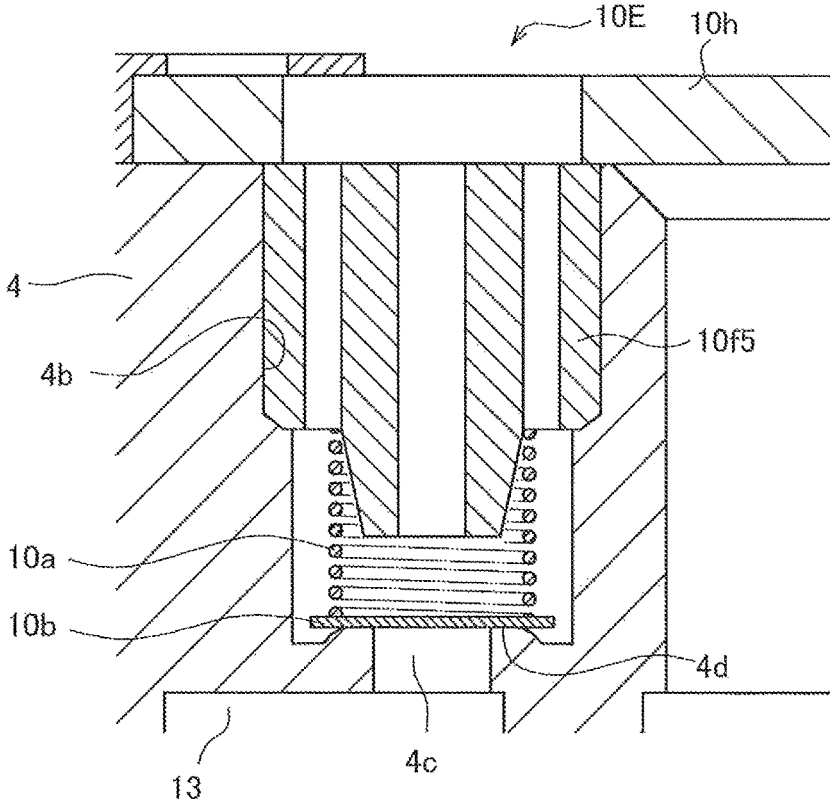
FIG. 10 is a cross-sectional view showing a valve closed state of the release valve device according to the conventional example.

Here, before describing the release valve device 10 (see FIG. 2 described later) included in the scroll compressor S (see FIG. 1) according to the first embodiment, a release valve device 10E included in a scroll compressor according to a conventional example will be described with reference to FIGS. 9 and 10. FIG. 9 is a cross-sectional view showing a valve open state of the release valve device 10E according to the conventional example. FIG. 10 is a cross-sectional view showing a valve closed state of the release valve device 10E according to the conventional example. The scroll compressor according to the conventional example is different in configuration of the release valve device 10E as compared with the scroll compressor S (see FIG. 1) according to the first embodiment. The other configurations are the same as the first embodiment, and descriptions thereof will be omitted.

The release valve device 10E according to the conventional example includes a valve seat surface 4*d* formed integrally with the fixed scroll 4, a spring 10*a*, a valve plate 10*b*, a stopper 10*f*5 and a retainer 10*h*.

On a side (an opposite side of the wrap) of the discharge pressure chamber 14 (see FIG. 1) of the fixed scroll 4, a housing hole 4*b* with a bottom is formed, and a release hole 4*c*, which communicates to the side (side of the wrap) of the compression chamber 13 from the bottom of the housing hole 4*b*, is formed. Thus, a flow passage communicating to the discharge pressure chamber 14 (see FIG. 1) is formed from the compression chamber 13 through the release hole 4*c* and the housing hole 4*b*. Note that, the release hole 4*c* is formed smaller in diameter than that of the housing hole 4*b*. Further, the valve seat surface (valve seat, protrusion) 4*d* in contact with the valve plate 10*b* is formed in a peripheral edge of the release hole 4*c* on a side (side of the discharge pressure chamber 14 (see FIG. 1)) of the housing hole 4*b*. That is, the seat valve surface 4*d* of the release valve device 10E according to the conventional example is formed integrally with the fixed scroll 4.

The spring 10*a*, the valve plate 10*b* and the stopper 10*f*5 are disposed inside the housing hole 4*b* formed in the fixed scroll 4. The spring 10*a* is supported by the stopper 10*f*5 at one end thereof, and is in contact with the valve plate 10*b* at the other end thereof, to bias the valve plate 10*b* in a direction of the valve seat surface 4*d* (release hole 4*c*). The stopper 10*f*5 supports the one end of the spring 10*a* and regulates maximum moving distance of the valve plate 10*b*. The retainer 10*h* is attached to the side of the discharge pressure chamber 14 (see FIG. 1) of the fixed scroll 4, to secure the stopper 10*f*5.

When pressure in the compression chamber 13 is lower than the discharge pressure (pressure in the discharge pressure chamber 14 (see FIG. 1)), the valve plate 10*b* is pressed against the valve seat surface 4*d* by a biasing force (an elastic force) of the spring 10*a* and this pressure difference, and the release valve 4*c* is in a blocked state. That is, the release valve device 10E is in a closed state (see FIG. 10).

On the other hand, under conditions of the equation (1), when the pressure in the compression chamber 13 is higher than the discharge pressure (pressure in the discharge pressure chamber 14 (see FIG. 1)), the valve plate 10*b* is pushed up from the valve seat surface 4*d* by fluid force, and the release valve 4*c* is opened. That is, the release valve device 10E is in an open state (see FIG. 9).

Here, when the release valve device 10E operates (that is, when the equation (1) is satisfied), the release valve device 10E is opened and closed once per rotation of the crankshaft 6. In other words, when the release valve device 10E operates, the valve plate 10*b* and the valve seat surface 4*d* collide with each other once per rotation of the crankshaft 6. For example, when the crankshaft 6 rotates at 3,000 revolutions per minute, the valve seat 4*d* is a severe contact surface in which 180,000 collisions are repeated per hour, and it is an important issue to ensure reliability of the valve seat surface 4*d*.

<Release Valve Device of First Embodiment>

Figure 2:
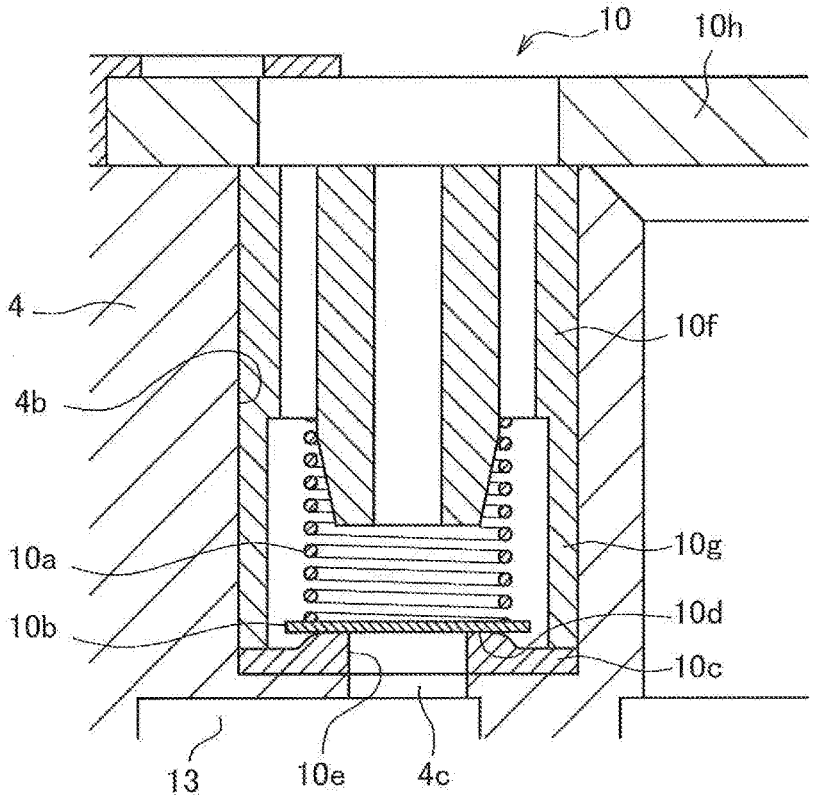
FIG. 2 is a cross-sectional view of a release valve device according to the first embodiment.

Next, the release valve device 10 included in the scroll compressor S according to the first embodiment will be described with reference to FIG. 2. FIG. 2 is a cross-sectional view of the release valve device 10 according to the first embodiment.

The release valve device 10 according to the first embodiment includes the spring 10*a*, the valve plate 10*b*, a valve seat member 10*c* having a valve seat surface 10*d* and a release hole 10*e*, a stopper 10*f* having a holding portion 10*g*, and a retainer 10*h*.

On the side of the discharge pressure chamber 14 (see FIG. 1) of the fixed scroll 4, the housing hole 4*b* with a bottom is formed, and the release hole 4*c*, which communicates to the side of the compression chamber 13 from the bottom of the housing hole 4*b*, is formed. Note that, the release hole 4*c* is formed smaller in diameter than that of the housing hole 4*b*.

While the valve seat surface 4*d* of the release valve device 10E (see FIGS. 9, 10) according to the conventional example is formed integrally with the fixed scroll 4, the valve seat surface 10*d* (see FIG. 2) of the release valve device 10 according to the first embodiment is formed in the seat valve member 10*c* separated from the fixed scroll 4. That is, the release hole 10*e* is formed in the valve seat member 10*c*, and the valve seat surface (valve seat, protrusion) 10*d* in contact with the valve plate 10*b* is provided in a peripheral edge of the release hole 10*e* on the side (side of the discharge pressure chamber 14 (see FIG. 1)) of the housing hole 4*b*. Then, by housing (placing) the valve seat member 10*c* in a bottom portion of the housing hole 4*b*, the release hole 10*e* of the valve seat member 10*c* and the release hole 4*c* of the fixed scroll 4 communicate with each other. Thus, the flow passage communicating to the discharge pressure chamber 14 (see FIG. 1) from the compression chamber 13 through the release hole 4*c*, the release hole 10*e* and the housing hole 4*b*, is formed.

As shown in FIG. 2, the spring 10*a*, the valve plate 10*b*, the valve seat member 10*c* and the stopper 10*f* are arranged inside the housing hole 4*b* formed in the fixed scroll 4. The spring 10*a* is supported by the stopper 10*f* at one end thereof, and is in contact with the valve plate 10*b* at the other end thereof, to bias the valve plate 10*b* in a direction of the valve seat surface 10*d* (release hole 10*e*). The stopper 10*f* supports the spring 10*a* and regulates the maximum moving distance of the valve plate 10*b*.

The retainer 10*h* is attached to the side of the discharge pressure chamber 14 (see FIG. 1) of the fixed scroll 4, to secure the stopper 10*f*. Then, the stopper 10*f* is provided with the annular (cylindrical) holding portion 10*g*, and the valve seat member 10*c* is fixed by being sandwiched between the holding portion 10*g* and the fixed scroll 4 (bottom portion of the housing hole 4*b*).

Basic opening and closing operation of the release valve device 10 according to the first embodiment is the same as the release valve device 10E (see FIGS. 9, 10) according to the conventional example described above, and a description thereof will be omitted.

<Operational Effects>

Operational effects of the scroll compressor S (see FIGS. 1, 2) including the release valve device 10 according to the first embodiment will be described in comparison with the scroll compressor including the release valve device 10E (see FIGS. 9, 10) according to the conventional example.

As described above, when using a next refrigerant (for example, R32, R290, R1234ze) as the refrigerant of the scroll compressor S, the orbiting scroll 3 is formed with a lightweight material such as an aluminum alloy or a magnesium alloy, in order to downsize and speed up the scroll compressor S. Further, in order to prevent efficiency reduction due to expansion of a gap inside the compressor by a difference in linear expansion coefficient, the fixed scroll 4 is formed with the same material as the orbiting scroll 3, that is, the lightweight material such as the aluminum alloy or the magnesium alloy. On the other hand, the valve plate 10*b* of the release valve device 10 is formed with a material such as a rolled steel plate.

Here, the aluminum alloy or the magnesium alloy has a Vickers hardness of about 150, and when the valve seat surface 4*d* is formed integrally with the fixed scroll 4 as the release valve device 10E (see FIGS. 9, 10) according to the conventional example, impact resistance is weak.

In contrast, the release valve device 10 (see FIG. 2) according to the first embodiment has the valve seat surface 10*d* formed in the valve seat member 10*c* separated from the fixed scroll 4. Therefore, the material of the valve seat member 10*c* (valve seat surface 10*d*) can be a material having higher impact resistance than that of the material (for example, aluminum alloy or magnesium alloy) of the fixed scroll 4.

That is, by forming the valve seat surface 10*d* in the valve seat member 10*c* separated from the fixed scroll 4, and by using a material having high Vickers hardness as the material of the valve seat member 10*c*, it is possible to improve reliability of the valve seat surface 10*d*. In particular, even when a lightweight material such as the aluminum alloy or the magnesium alloy having low Vickers hardness is used as the orbiting scroll 3 or the fixed scroll 4, it is possible to ensure reliability of the release valve device 10.

Meanwhile, in the scroll compressor including the release valve device 10E (see FIGS. 9, 10) according to the conventional example, cast iron is widely used as the material of the fixed scroll 4. Considering this use results, it is desirable to use a material having a Vickers hardness of equal to or more than 250 as the material of the valve seat member 10*c* of the release valve device 10 (see FIG. 2) according to the first embodiment.

As the material used as the valve seat member 10*c* having the valve seat surface 10*d*, for example, a molding material can be used. In addition, a molding material subjected to nitriding treatment may be used. An iron-based material or a steel material may be used, and an iron-based material or a steel material subjected to nitriding treatment may be used, and further an iron-based material or a steel material subjected to carburizing quenching treatment may be used. A sintered material subjected to steam treatment may be used, and a sintered material subjected to steam treatment and nitriding treatment may be used.

Thus, in the scroll compressor S including the release valve device 10 (see FIG. 2) according to the first embodiment, even when using the lightweight material such as the aluminum alloy and the magnesium alloy as the material of the orbiting scroll 3 and the fixed scroll 4, it is possible to ensure the reliability of the release valve device 10. Further, by using the lightweight material as the orbiting scroll 3, it is possible to provide the scroll compressor S capable of high-speed rotation as well as using the next refrigerant.

Second Embodiment

Next, the scroll compressor S according to a second embodiment will be described. The scroll compressor S according to the second embodiment is different in configuration of a release valve device 10A as compared with the scroll compressor S (see FIG. 1) according to the first embodiment. The other configurations are the same as the first embodiment, and descriptions thereof will be omitted.

<Release Valve Device of Second Embodiment>

Figure 3:
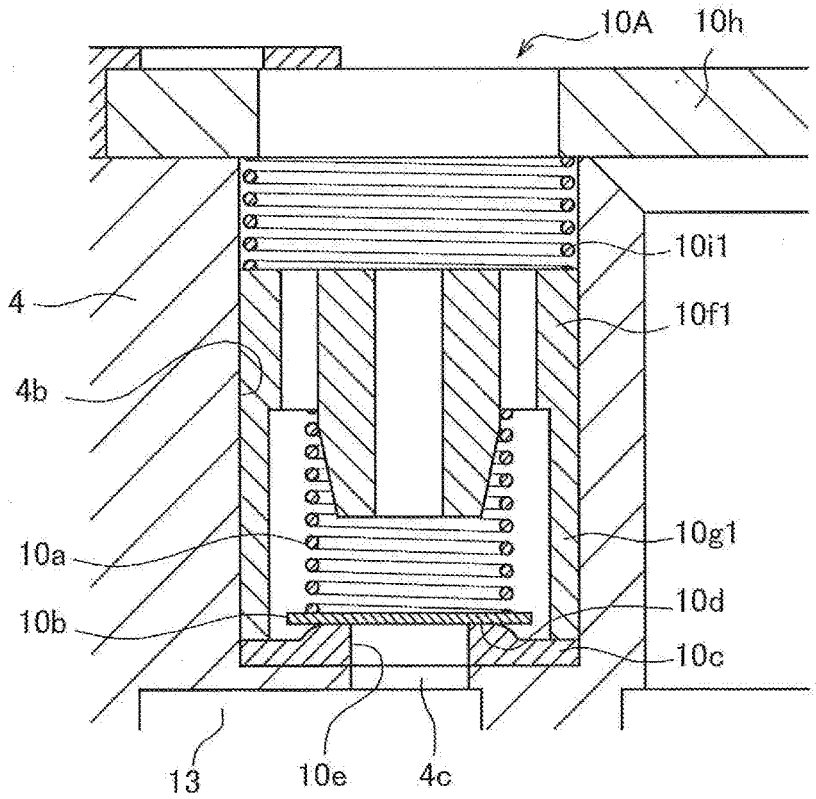
FIG. 3 is a cross-sectional view of a release valve device according to a second embodiment.

The release valve device 10A included in the scroll compressor S according to the second embodiment will be described with reference to FIG. 3. FIG. 3 is a cross-sectional view of the release valve device 10A according to the second embodiment.

The release valve device 10A according to the second embodiment included the spring (a first spring) 10*a*, the valve plate 10*b*, the valve seat member 10*c* having the valve seat surface 10*d* and the release hole 10*e*, a stopper 10*f*1 having a holding portion 10*g*1, a pressing spring (second spring) 10*i*1, and the retainer 10*h*.

The retainer 10*h* is attached to the side of the discharging chamber 14 (see FIG. 1) of the fixed scroll 4, and secures the stopper 10*f*1 via the pressing spring 10*i*1. Then, the stopper 10*f*1 is provided with the annular (cylindrical) holding portion 10*g*1, and the valve seat member 10*c* is fixed by being sandwiched between the holding portion 10*g*1 and the fixed scroll 4 (bottom portion of the housing hole 4*b*).

The other configurations and basic opening and closing operation of the release valve device 10A according to the second embodiment is the same as the release valve device 10 (see FIG. 2) according to the first embodiment, and descriptions thereof will be omitted.

<Operational Effects>

Operational effects of the scroll compressor S including the release valve device 10A (see FIG. 3) according to the second embodiment will be described.

The release valve device 10A (see FIG. 3) according to the second embodiment has the pressing spring 10*i*1 inserted over the stopper 10*f*1. By pressing down the pressing spring 1011 and the stopper 10*f*1 by the retainer 10*h*, the pressing spring 10*i*1 is deflected, and even when machining accuracy of the housing hole 4*b* is low, it is possible to absorb dimension error thereof. That is, even when a length of the housing hole 4*b* is short, a tooth bottom (base plate of the fixed scroll wrap) of the fixed scroll 4 is prevented from being strongly pressed to be deformed, by contraction of the pressing spring 10*i*1 when the retainer is attached, and thus sliding loss with the orbiting scroll 3 is prevented from increasing. Further, even when the length of the housing hole 4*b* is long, the valve seat member 10*c* is fixed and prevented from moving, by extension of the pressing spring

10*i*1 when the retainer is attached, and thus it is possible to prevent fretting wear or the like which is generated by wear with the housing hole 4*b* due to movement of the valve seat member 10*c*.

Further, as for depth machining accuracy of the housing hole 4*b* of the fixed scroll 4 according to the second embodiment, high machining accuracy is not required as in the first embodiment, and thus productivity of the fixed scroll 4, and consequently productivity of the scroll compressor S is improved.

Third Embodiment

Next, the scroll compressor S according to a third embodiment will be described. The scroll compressor S according to the third embodiment is different in configuration of a release valve device 10B as compared with the scroll compressor S (see FIG. 1) according to the first embodiment. The other configurations are the same as the first embodiment, and descriptions thereof will be omitted.

<Release Valve Device of Third Embodiment>

Figure 4:
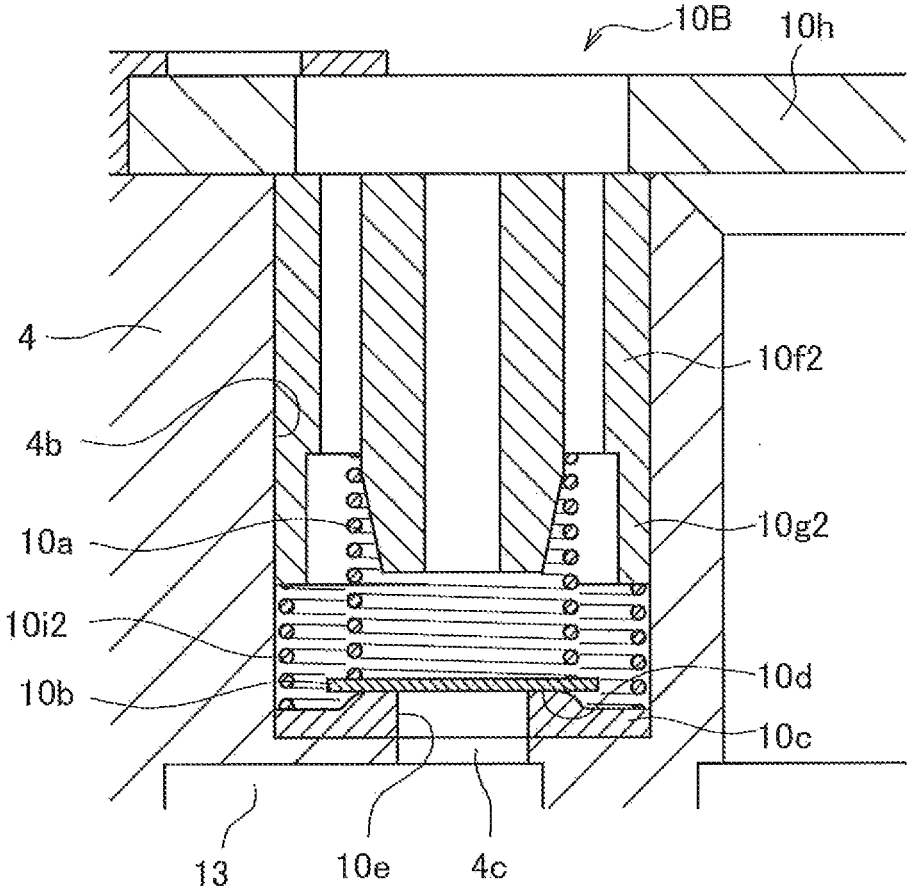
FIG. 4 is a cross-sectional view of a release valve device according to a third embodiment.

The release valve device 10B included in the scroll compressor S according to the third embodiment will be described with reference to FIG. 4. FIG. 4 is a cross-sectional view of the release valve device 10B according to the third embodiment.

The release valve device 10B according to the third embodiment includes the spring (first spring) 10*a*, the valve plate 10*b*, the valve seat member 10*c* having the valve seat surface 10*d* and the release hole 10*e*, a stopper 10*f*2 having a holding portion 10*g*2, a pressing spring (second spring) 10*i*2, and the retainer 10*h*.

The retainer 10*h* is attached to the side of the discharge pressure chamber 14 (see FIG. 1) of the fixed scroll 4, to secure the stopper 10*f*2. Then, the stopper 10*f*2 is provided with the annular (cylindrical) holding portion 10*g*2, and the pressing spring 10*i*2 is disposed between the holding portion 10*g*2 and the valve seat member 10*c*. Thus, the valve seat member 10*c* is fixed by being sandwiched between the pressing spring 10*i*2 and the fixed scroll 4 (bottom portion of the housing hole 4*b*).

The other configurations and basic opening and closing operation of the release valve device 10B according to the third embodiment is the same as the release valve device 10 (see FIG. 2) according to the first embodiment, and descriptions thereof will be omitted.

<Operational Effects>

Operational effects of the scroll compressor S including the release valve device 10B (see FIG. 4) according to the third embodiment will be described.

The release valve device 10B (see FIG. 4) according to the third embodiment has the pressing spring 10*i*2 inserted under the stopper 10*f*2 (holding portion 10*g*2). By pressing down the pressing spring 10*i*2 and the stopper 10*f*2 by the retainer 10*h*, the pressing spring 10*i*2 is deflected, and even when machining accuracy of the housing hole 4*b* is low, it is possible to absorb dimension error thereof in the same manner as the release valve device 10A (see FIG. 2) according to the second embodiment. This prevents the tooth bottom of the fixed scroll 4 from being deformed as well as preventing the valve seat member 4*c* from moving. Further, as for depth machining accuracy of the housing hole 4*b* of the fixed scroll 4 according to the third embodiment, high machining accuracy is not required as in the first embodiment, and thus productivity of the fixed scroll 4, and consequently productivity of the scroll compressor S is improved.

Fourth Embodiment

Next, the scroll compressor S according to a fourth embodiment will be described. The scroll compressor S according to the fourth embodiment is different in configuration of a release valve device 10C as compared with the scroll compressor S (see FIG. 1) according to the first embodiment. The other configurations are the same as the first embodiment, and descriptions thereof will be omitted.

<Release Valve Device of Fourth Embodiment>

Figure 5:
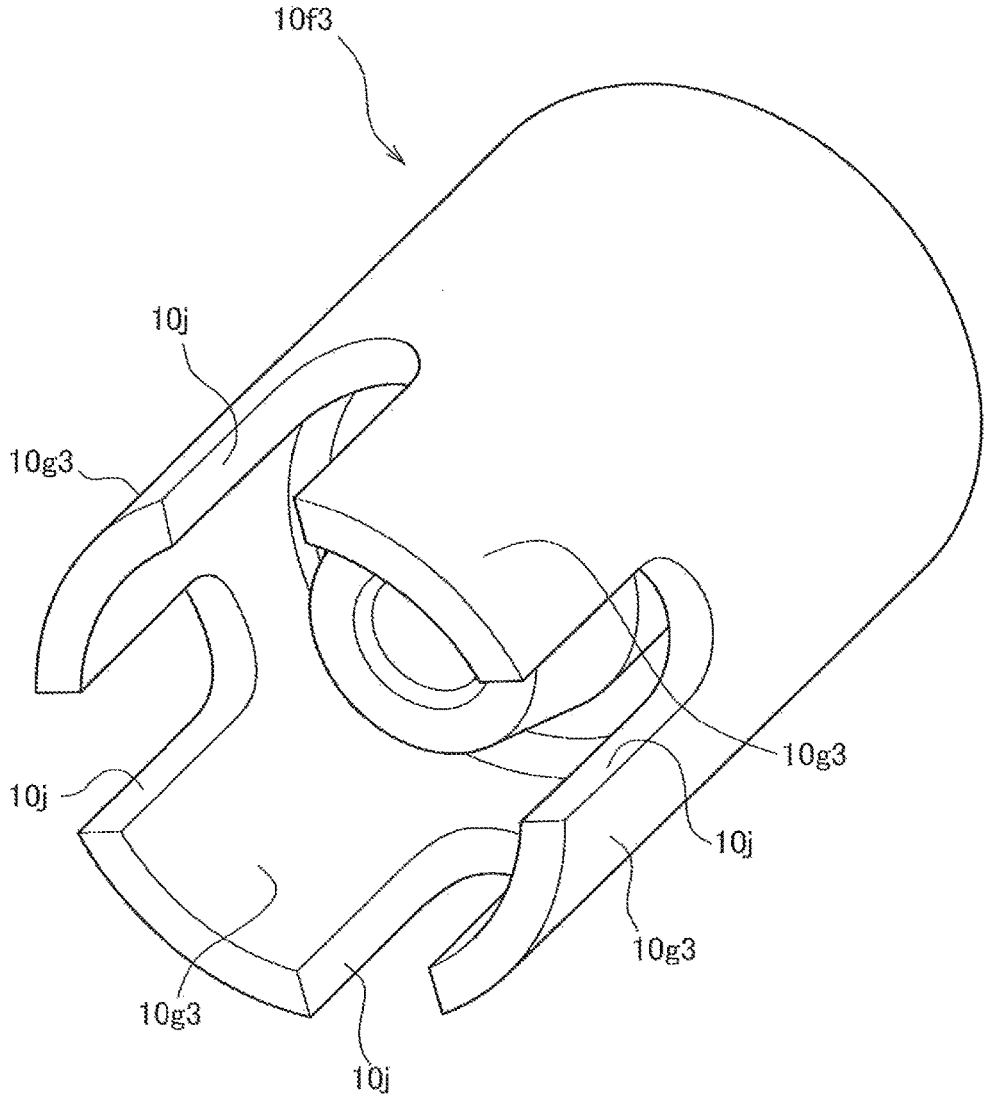
FIG. 5 is a perspective view of a stopper included in a release valve device according to a fourth embodiment.
Figure 6:
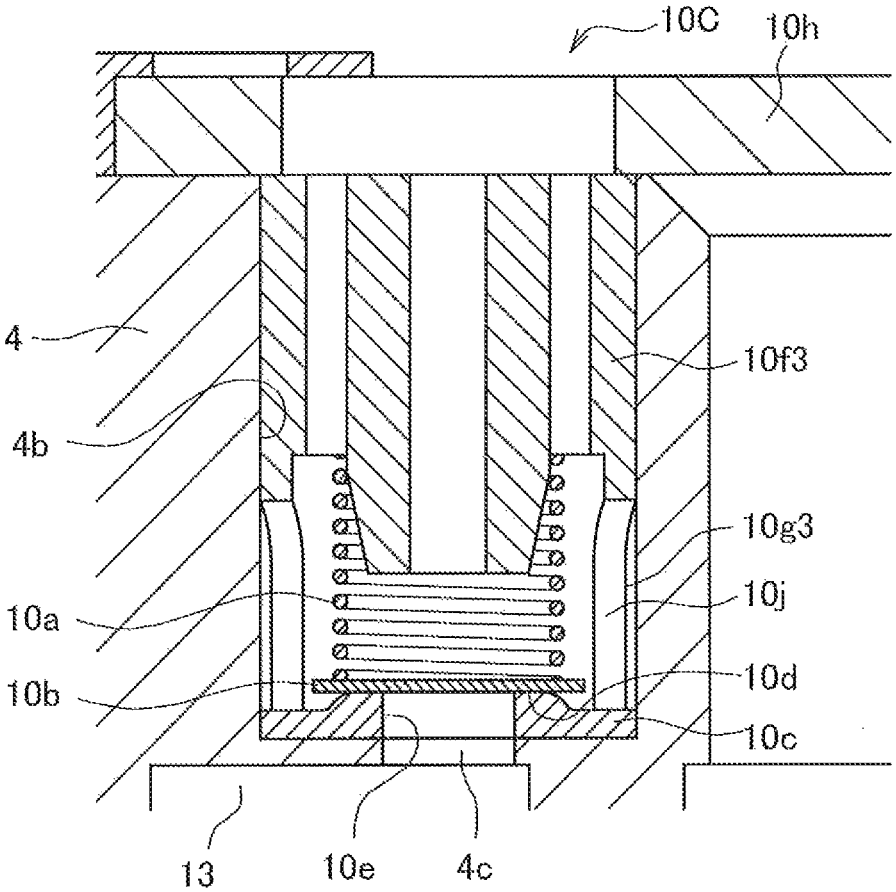
FIG. 6 is a cross-sectional view of the release valve device according to the fourth embodiment.

The release valve device 10C included in the scroll compressor S according to the fourth embodiment will be described with reference to FIGS. 5 and 6. FIG. 5 is a perspective view of a stopper 10*f*3 included in the release valve device 10C according to the fourth embodiment. FIG. 6 is a cross-sectional view of the release valve device 10C according to the fourth embodiment.

As shown in FIG. 6, the release valve device 10C according to the fourth embodiment includes the spring 10*a*, the valve plate 10*b*, the valve seat member 10*c* having the valve seat surface 10*d* and the release hole 10*e*, the stopper 10*f*3 having a holding portion 10*g*3 provided with cutout portions 10*j*, and the retainer 10*h*.

That is, the stopper 10*f* of the release valve device 10 (see FIG. 2) according to the first embodiment is provided with the annular (cylindrical) holding portion 10*g*, whereas as shown in FIG. 5, the stopper 10*f*3 of the release valve device 10C according to the fourth embodiment is provided with the cutout portions 10*j* in the annular (cylindrical) holding portion 10*g*3 thereof.

The other configurations and basic opening and closing operation of the release valve device 10C according to the fourth embodiment is the same as the release valve device 10 (see FIG. 2) according to the first embodiment, and descriptions thereof will be omitted.

<Operational Effects>

Operational effects of the scroll compressor S including the release valve device 10C (see FIGS. 5, 6) according to the fourth embodiment will be described in comparison with the scroll compressor S including the release valve device 10 (see FIG. 2) according to the first embodiment.

In the release valve device 10 (see FIG. 2) according to the first embodiment, when the release valve device 10 operates (that is, when the equation (1) is satisfied), a portion where the flow passage of refrigerant gas flowing to the discharge pressure chamber 14 (see FIG. 1) from the compression chamber 13 is most narrowed, is a gap portion between the valve plate 10*b* and an inner peripheral surface of the stopper 10*f* (holding portion 10*g*). Flow passage area of the gap portion can be ensured, such as by reducing a diameter of the valve plate 10*b*, however, considering constraint that the valve plate 10*b* does not depart from the contact surface with the valve seat surface 10*d*, or that the valve plate 10*b* is not inclined in the stopper 10*f* so as not to come off from the spring 10*a*, it is not possible to enlarge the gap portion too much.

In contrast, in the release valve device 10C (see FIGS. 5, 6) according to the fourth embodiment, the annular (cylindrical) holding portion 10*g*3 of the stopper 10*f*3 is provided with the cutout portions 10*j*. As shown in FIG. 6, by providing the cutout portions 10*j*, it is possible to increase the flow passage area of the gap portion between the valve plate 10*b* and the stopper 10*f*3, thereby reducing pressure loss of the release valve device 10C.

Note that, the release valve device 10C (see FIGS. 5, 6) according to the fourth embodiment has been described as providing the cutout portions 10*j* in the holding portion 10*g*3 of the stopper 10*f*3 of the release valve device 10 (see FIG. 2) according to the first embodiment, however, it is not limited thereto, and the cutout portions 10*j* may be provided in the holding portion 10*g*1 of the stopper 10*f*1 of the release valve device 10A (see FIG. 3) according to the second embodiment.

Fifth Embodiment

Next, the scroll compressor S according to a fifth embodiment will be described. The scroll compressor S according to the fifth embodiment is different in configuration of a release valve device 10D as compared with the scroll compressor S (see FIG. 1) according to the first embodiment. The other configurations are the same as the first embodiment, and descriptions thereof will be omitted.

<Release Valve Device of Fifth Embodiment>

Figure 7:
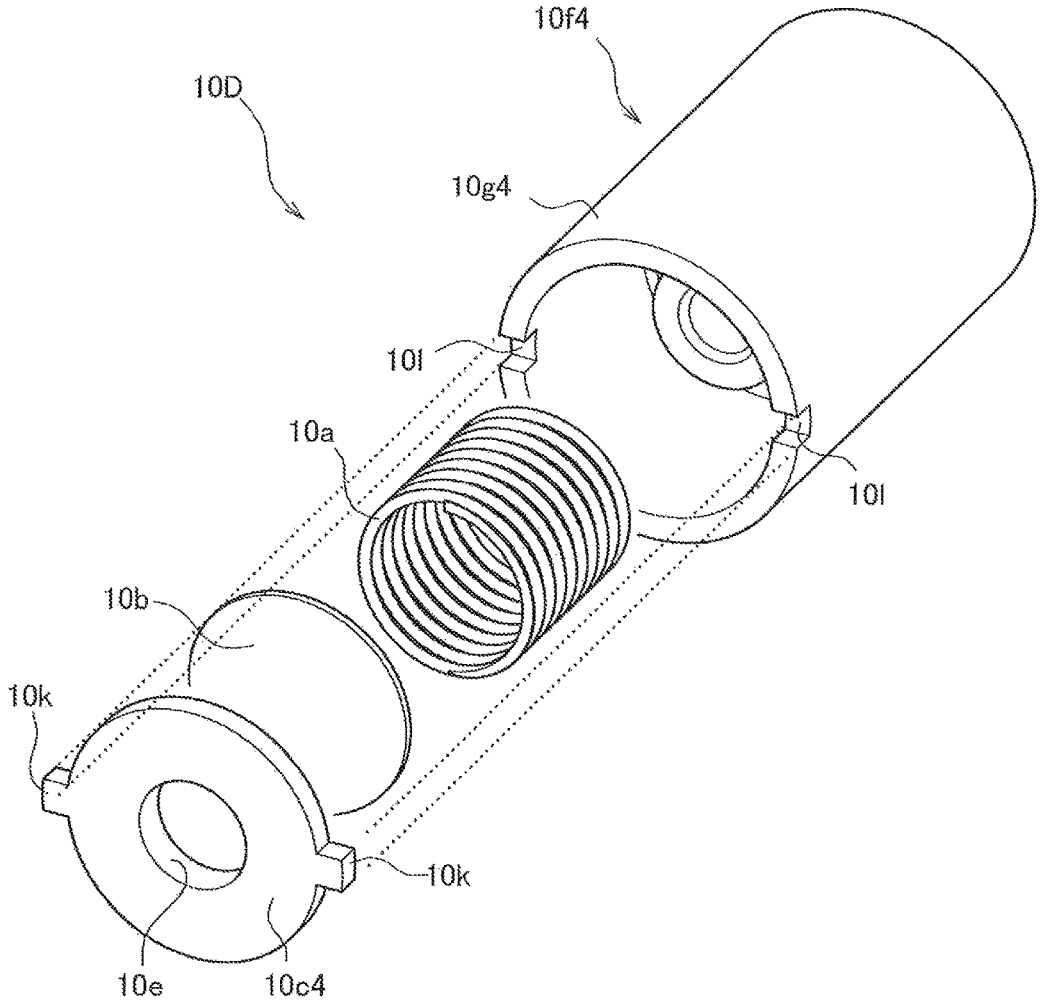
FIG. 7 is an exploded perspective view of a release valve device according to a fifth embodiment.
Figure 8:
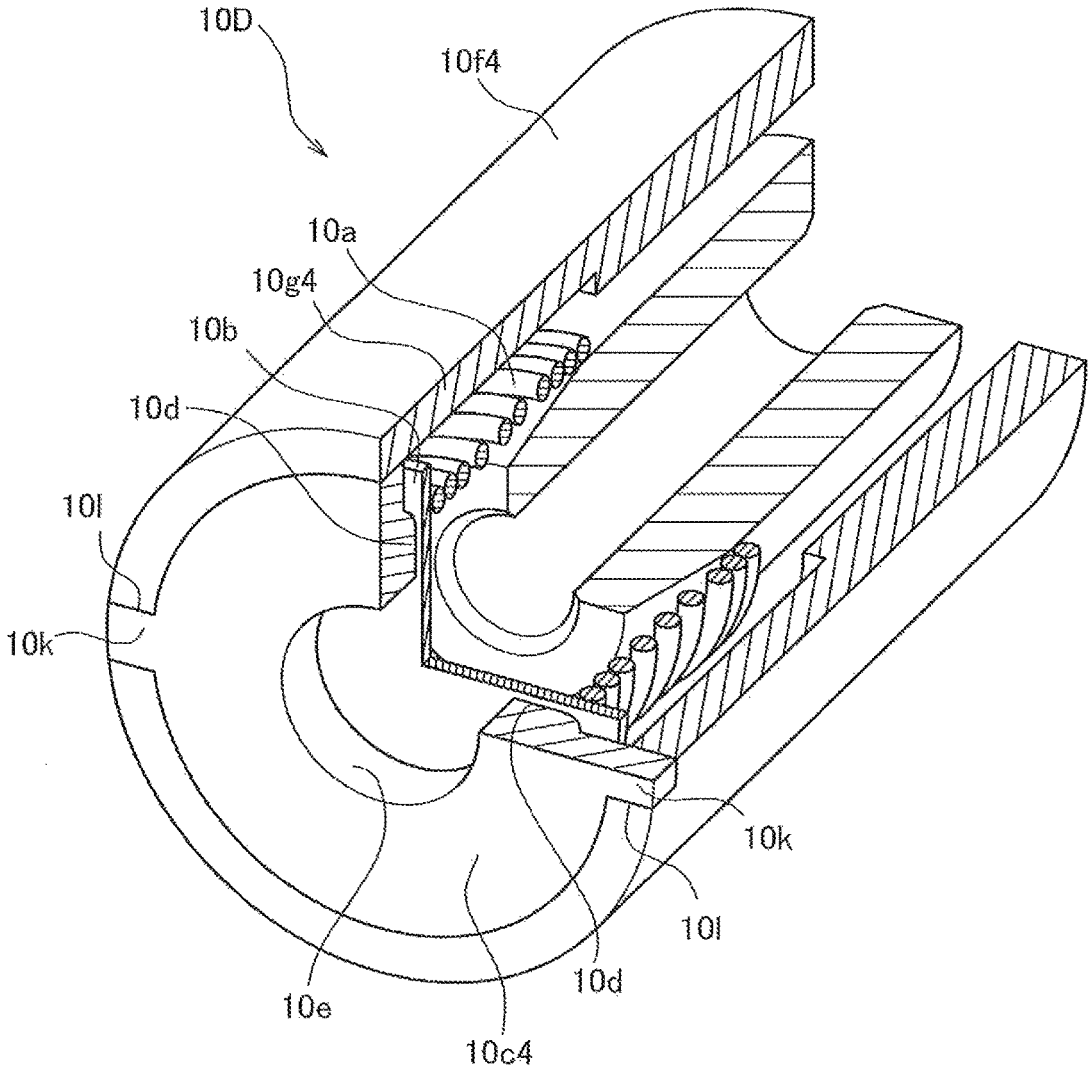
FIG. 8 is an assembly perspective view taken along a portion of the release valve device according to the fifth embodiment.

The release valve device 10D included in the scroll compressor S according to the fifth embodiment will be described with reference to FIGS. 7 and 8. FIG. 7 is an exploded perspective view of the release valve device 10D according to the fifth embodiment. FIG. 8 is an assembly perspective view taken along a portion of the release valve device 10D according to the fifth embodiment.

As shown in FIGS. 7 and 8, the release valve device 10D according to the fifth embodiment includes the spring 10*a*, the valve plate 10*b*, a valve seat member 10*c*4 having the valve seat surface 10*d*, the release hole 10*e* and protrusions 10*k*, a stopper 10*f*4 having a holding portion 10*g*4 provided with grooves 10I, and the retainer (not shown).

The valve seat member 10*c*4 is provided with the protrusions 10*k* in an outer peripheral portion thereof, and the protrusions 10*k* are configured to be fitted into the grooves 10I formed in the stopper 10*f*4 such as by press-fitting.

The other configurations and basic opening and closing operation of the release valve device 10D according to the fifth embodiment is the same as the release valve device 10 (see FIG. 2) according to the first embodiment, and descriptions thereof will be omitted.

<Operational Effects>

Operational effects of the scroll compressor S including the release valve device 10D (see FIGS. 7, 8) according to the fifth embodiment will be described.

With such a structure, as shown in FIG. 8, it is possible to produce an assembly of the release valve device 10, and this assembly only has to be inserted into the housing hole 4*b*, and thus assembling property of the scroll compressor S is improved.

Note that, the release valve device 10D (see FIGS. 7, 8) according to the fifth embodiment has been described such that the retainer (not shown) presses the stopper 10*f*4 in the same manner as the release valve device 10 (see FIG. 2) according to the first embodiment, however, it is not limited thereto, and the pressing spring 10*i*1 (see FIG. 3) may be placed between the retainer (not shown) and the stopper 10*f*4 in the same manner as the release valve device 10A (see FIG. 3) according to the second embodiment. Further, in the same manner as the release valve device 10C (see FIGS. 5, 6) according to the fourth embodiment, the cutout portions 10*j* (see FIG. 3) may be provided in positions different from positions where the grooves 10I are provided in the holding portion 10*g*4 of the stopper 10*f*4. Furthermore, they may be combined.

<<Modification>>

Note that, the scroll compressor S according to the embodiments (first to fifth embodiments) is not limited to the configurations in the embodiments, and various modifications may be made without departing from the spirit and scope of the invention.

In the above embodiments (first to fifth embodiments), the release valve devices 10, 10A to 10D are taken as examples, however, the present invention can be applied to valve devices that perform the same operations as the release valve devices 10, 10A to 10D used in the scroll compressor S.

As shown in FIG. 1, the scroll compressor S is provided with the back pressure chamber 15 of a pressure between the suction pressure and the discharge pressure on the back of the orbiting scroll 3. Pressure in the back pressure chamber 15 is regulated by a back pressure control valve 16 provided in a flow passage between the back pressure chamber 15 and the compression chamber 13, and the back pressure control valve 16 has a check valve structure using a spring similarly to the release valve device 10 and includes a valve seat surface. The back pressure control valve 16 is also a valve device which performs opening and closing operation once per rotation of the crankshaft 6, and impact resistance of the valve seat surface is required. The present invention can also be applied to the back pressure control valve 16.

Further, although not shown, there is also the scroll compressor S provided with a back pressure release valve device (not shown, for example, the back pressure release valve device of Japanese Patent Publication No. 5022010) for communicating the back pressure chamber 15 and the discharge pressure chamber 14 by opening a valve thereof when the pressure in the back pressure 15 is higher than the discharge pressure (pressure of the discharge pressure chamber 14). Such a back pressure release valve device (not shown) is provided in the frame 5. Here, the frame 5 is fastened to the fixed scroll 4 by the fastener 5*b*, and houses the orbiting scroll 3 therein while forming the back pressure chamber 15. Therefore, in order to prevent deformation or the like due to a difference in linear expansion coefficient, it is preferable to form the frame 5 with the same material as the orbiting scroll 3 and the fixed scroll 4, that is, the lightweight material such as the aluminum alloy or the magnesium alloy. The back pressure release valve device (not shown) has the check valve structure using the spring similarly to the release valve device 10, and includes the valve seat surface. The present invention can also be applied to the back pressure release valve device (not shown).

However, since operation frequency of the back pressure release valve device (not shown) is smaller than that of the release valve device 10 or the back pressure control valve 16, the back pressure release valve device may remain in the same structure as the conventional release valve device 10E (see FIGS. 9, 10) without using the structure of the release valve devices 10, 10A to 10D of the present invention.

REFERENCE SIGNS LIST

S: scroll compressor
1: sealed container
1*a*: case
1*b*: lid chamber
1*c*: bottom chamber
1*d*: suction pipe
1*e*: discharge pipe

2: compression mechanism
3: orbiting scroll
3*a*: orbiting bearing
4: fixed scroll
4*a*: discharge port
4*b*: housing hole
4*c*: release hole
4*d*: valve seat surface
5: frame
5*a*: main bearing
5*b*: fastener
6: crankshaft
6*a*: main shaft
6*b*: eccentric portion
6*c*: oil supply passage
6*d*: oil supply pipe
7: Oldham ring
8: electric motor
8*a*: stator
8*b*: rotor
9: lower bearing
10, 10A, 10B, 10C, 10D: release valve device
10*a*: spring (first spring)
10*b*: valve plate
10*c*, 10*c*4: valve seat member
10*d*: valve seat surface
10*e*: release hole
10*f*, 10*f*1, 10*f*2, 10*f*3, 10*f*4: stopper
10*g*, 10*g*1, 10*g*2, 10*g*3, 10*g*4: holding portion (cylindrical portion)
10*h*: retainer
10*i*1, 10*i*2: pressing spring (second spring)
10*j*: cutout portion
10*k*: protrusion
10I: groove
11: machine oil
12: suction chamber
13: compression chamber
14: discharge pressure chamber
15: back pressure chamber
16: back pressure control valve

The invention claimed is:

1. A scroll compressor comprising:
an orbiting scroll having an orbiting scroll wrap;
a fixed scroll having a fixed scroll wrap intermeshing with the orbiting scroll wrap;
a release hole disposed in the fixed scroll;
a housing hole communicating with the release hole and having a larger diameter than that of the release hole;
a valve seat member which is housed in the housing hole and has a valve seat surface;
a valve plate contacting with or separating from the valve seat surface by a pressure difference;
a spring for pressing the valve plate against the valve seat surface;
a stopper supporting the spring and securing the valve seat member; and
a retainer for securing the stopper,
wherein a hardness of the valve seat member is higher than that of the fixed scroll, and
wherein the stopper has a cylindrical portion in contact with the valve seat member and has a cutout portion in the cylindrical portion.

2. A scroll compressor comprising:
an orbiting scroll having an orbiting scroll wrap;
a fixed scroll having a fixed scroll wrap intermeshing with the orbiting scroll wrap;
a release hole disposed in the fixed scroll;
a housing hole communicating with the release hole and having a larger diameter than that of the release hole;
a valve seat member which is housed in the housing hole and has a valve seat surface;
a valve plate contacting with or separating from the valve seat surface by a pressure difference;
a first spring for pressing the valve plate against the valve seat surface;
a stopper supporting the first spring and securing the valve seat member;
a second spring for pressing the stopper; and
a retainer for pressing the second spring,
wherein a hardness of the valve seat member is higher than that of the fixed scroll.

3. A scroll compressor comprising:
an orbiting scroll having an orbiting scroll wrap;
a fixed scroll having a fixed scroll wrap intermeshing with the orbiting scroll wrap;
a release hole disposed in the fixed scroll;
a housing hole communicating with the release hole and having a larger diameter than that of the release hole;
a valve seat member which is housed in the housing hole and has a valve seat surface;
a valve plate contacting with or separating from the valve seat surface by a pressure difference;
a first spring for pressing the valve plate against the valve seat surface;
a stopper supporting the first spring;
a second spring disposed between the stopper and the valve seat member; and
a retainer for securing the stopper,
wherein a hardness of the valve seat member is higher than that of the fixed scroll.

4. The scroll compressor according to claim 1,
wherein the valve seat member has a protrusion, and
wherein the stopper has a cylindrical portion in contact with the valve seat member, and the cylindrical portion has a groove into which the protrusion is pressed.

5. The scroll compressor according to claim 1,
wherein a material of the fixed scroll and the orbiting scroll is an aluminum alloy or a magnesium alloy.

6. The scroll compressor according to claim 1,
wherein a material of the valve seat member has a Vickers hardness equal to or more than 250.

7. The scroll compressor according to claim 1,
wherein the material of the valve seat member is one of a molding material, a steel material, a sintered material subjected to steam treatment, a molding material subjected to nitriding treatment, a steel material subjected to nitriding treatment, a sintered material subjected to steam treatment and nitriding treatment, and a steel material subjected to carburizing quenching treatment.

8. The scroll compressor according to claim 1,
wherein the release hole communicates with a compression chamber, and
wherein the housing hole communicates with a discharge pressure chamber.

9. The scroll compressor according to claim 1,
wherein the release hole communicates with a back pressure chamber, and
wherein the housing hole communicates with a compression chamber.

10. The scroll compressor according to claim 2,
wherein the stopper has a cylindrical portion in contact with the valve seat member and has a cutout portion in the cylindrical portion.

11. The scroll compressor according to claim 2, wherein the valve seat member has a protrusion, and wherein the stopper has a cylindrical portion in contact with the valve seat member, and the cylindrical portion has a groove into which the protrusion is pressed.

* * * * *